United States Patent [19]

Triplette

[11] 4,063,330

[45] Dec. 20, 1977

[54] HINGE AND CATCH ASSEMBLY

[75] Inventor: Robert Eugene Triplette, Winston-Salem, N.C.

[73] Assignee: Southern Tool Mfg. Co., Inc., Winston-Salem, N.C.

[21] Appl. No.: 764,262

[22] Filed: Jan. 31, 1977

[51] Int. Cl.[2] ..... E05D 11/08

[52] U.S. Cl. ..... 16/142; 16/145; 16/147; 24/208 A; 49/383; 292/17

[58] Field of Search ..... 49/383; 16/147, 139, 16/140, 146, 142, 145, 137, 144; 292/17; 24/208 A

[56] References Cited

U.S. PATENT DOCUMENTS

| | | | |
|---|---|---|---|
| 2,526,209 | 10/1950 | Durup | 16/142 |
| 2,571,430 | 10/1951 | Durup | 16/145 |
| 2,577,456 | 12/1951 | Doman | 16/142 |
| 2,946,612 | 7/1960 | Ahlgren | 292/17 |
| 3,135,820 | 6/1964 | Hallett, Jr. et al. | 24/208 A X |
| 3,418,682 | 12/1968 | Anderson | 16/145 |

FOREIGN PATENT DOCUMENTS

| | | | |
|---|---|---|---|
| 971,786 | 10/1964 | United Kingdom | 292/17 |

*Primary Examiner*—Philip C. Kannan
*Attorney, Agent, or Firm*—A. Yates Dowell, Jr.

[57] ABSTRACT

A catch apparatus for use with hinges having generally parallel butt plates or wings connected together by a hinge pin and in which the catch apparatus includes a male member received within a female member for releasably holding the hinge plates in generally parallel relationship.

6 Claims, 4 Drawing Figures

HINGE AND CATCH ASSEMBLY

BACKGROUND OF THE INVENTION

1. Field of the Invention

This invention relates generally to means for holding a door in closed position and relates particularly to a hinge and catch assembly in which the hinge has a pair of wings which are adapted to be releasably held in substantially parallel relationship with each other by the catch assembly.

2. Description of the Prior Art

Heretofore most of the doors on cabinets and other articles of furniture have been swingably mounted by hinges located along one side of the door so that the door could be opened when desired to provide access to the interior of the hollow structure. Most of the doors have been provided with a magnetic catch or spring catch on the side of the door remote from the hinges to hold the door closed but permitting opening of the door with a slight pull when desired.

Some efforts have been made to provide a spring type clip on one portion of the hinge of a door with such clip adapted to override and frictionally engage section of the other portion of the hinge to hold the door in closed position. Some examples of this type of construction are the U.S. patents to Doman 2,577,456 and Anderson 3,418,682 and the British patent to Collins 692,160. The U.S. patent to Durop 2,526,209 discloses a hinge having a male member fixed to one wing in which the male member has an enlarged head that is adapted to be received within a split resilient spring member mounted on the other wing of the hinge.

SUMMARY OF THE INVENTION

The present invention is embodied in a hinge of the butt, piano, or self-mortise type having a pair of generally parallel wings or butt plates connected together by a hinge pin. One of the wings loosely receives a male catch member and the other wing loosely receives a female catch member with such catch members having self-aligning features so that when the hinge is closed the male member is received within the female member to hold the hinge wings substantially in parallel relationship with each other. The male member includes a tapered base portion connected by a reduced neck to an enlarged generally hemispherical head. The female member includes a tapered base portion connected by a reduced neck to an enlarged generally cylindrical head. The female member includes an axial bore of a diameter less than the diameter of the head of the male member and a concentric counterbore having a diameter providing an interference fit with the diameter of the head of the male member. The head portion of the female member extends outwardly from one wing of the hinge a distance substantially equal to the spacing between the hinge wings when the wings are closed to stop the closing of the wings when the wings are substantially parallel.

It is an object of the invention to provide catch members loosely mounted on the wings of a hinge and adapted to releasably hold such wings in generally parallel relationship when the hinge is closed and in which such catch members are self-aligning.

DESCRIPTION OF THE PREFERRED EMBODIMENT

Figure 1:
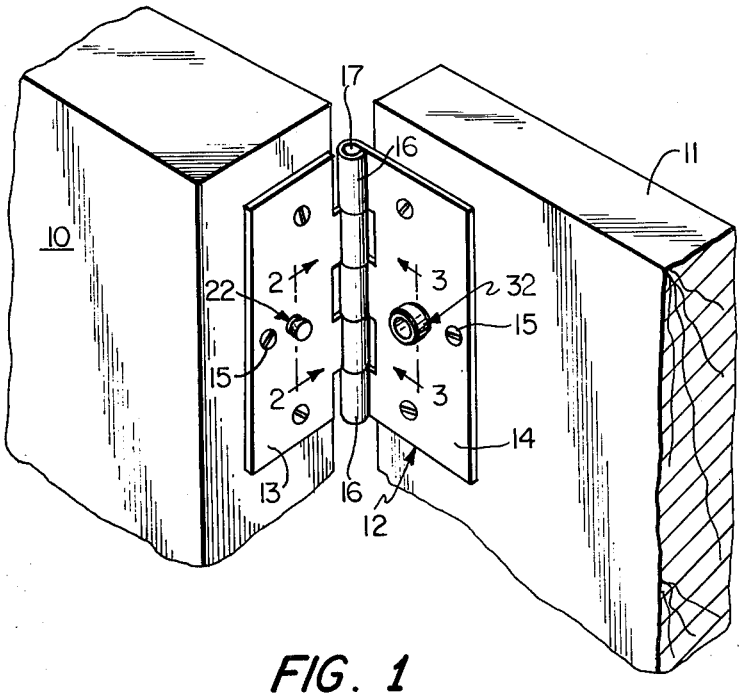
FIG. 1 is a perspective illustrating one application of the invention.

With continued reference to the drawing, a fixed structure 10, such as the walls of a cabinet or other hollow structure, is provided with a door 11 which normally closes an opening in the fixed structure. The door 11 is connected to the fixed structure by one or more hinges 12 which normally are of the butt, piano, or self-mortise type. Each of the hinges includes a pair of wings, leaves, or butt plates 13 and 14, having a plurality of openings for the reception of screws or other fasteners 15 by which the plates are fastened securely to the fixed structure 10 and the door 11. Each of the wings or butt plates is provided with one or more spaced sleeves 16 integrally attached thereto along one edge with the sleeves of one butt plate being alternately aligned with the sleeves of the other butt plate so that a common hinge pin 17 rotatably connects the butt plates together. When the door is closed, the butt plates 13 and 14 are generally parallel or normally within five degrees of parallelism with each other. Preferably the cabinet or fixed structure 10 and the door 11 are mortised or notched to a depth substantially equal to the thickness of the butt plates so that the plates are recessed within the fixed structure and the door.

Figure 2:
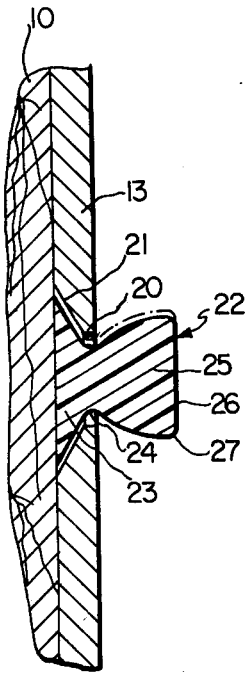
FIG. 2 is an enlarged fragmentary sectional view on the line 2—2 of FIG. 1.
Figure 4:
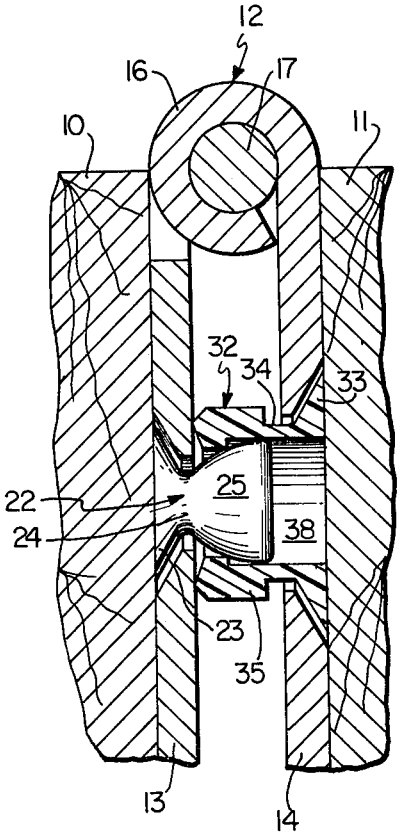
FIG. 4 is an enlarged sectional view illustrating the hinge and catch members in closed relationship.

With particular reference to FIGS. 2 and 4, the butt plate 13 is provided with an opening 20 generally centrally of the plate and such opening communicates with a frusto-conical countersink 21 which extends inwardly from the back of the butt plate or the side adjacent to the fixed structure 10. A male catch member 22 is carried by the butt plate 13 and such male member normally is constructed of a thermoplastic material having some resiliency such as nylon, polyethylene, polyurethane, or the like. The male member includes a generally frusto-conical base 23 connected by a reduced throat 24 to an enlarged generally hemispherical head 25 which terminates in a generally flat outer surface 26. The frusto-conical base 23 is slightly smaller than the countersink 21 of the butt plate to premit limited movement of the male catch member within the opening 20 and the countersink 21. The hemispherical head 25 has a diameter greater than the diameter of the opening 20 of the plate 13 so that the male member 22 must be press fitted through such opening. Preferably the intersection between the hemispherical head 25 and the flat surface 26 has a chamfer 27 or is provided with a radius to assist in the press fitting operation as well as for a purpose which will be described later.

With particular reference to FIG. 2, it is noted that after the head 25 has been force-fitted through the opening 20, the male catch member and the butt plate 13 will remain in assembled relationship during shipping or transporting from the manufacturer to the eventual user; however, it is apparent that the male catch member has limited in-and-out, as well as lateral, movement relative to the butt plate.

Figure 3:
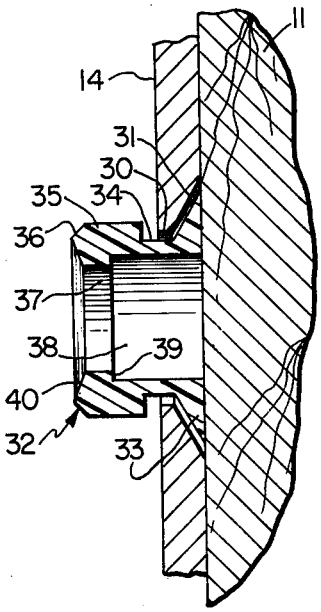
FIG. 3 is an enlarged fragmentary sectional view on the line 3—3 of FIG. 1.

With particular reference to FIGS. 3 and 4, the butt plate 14 is provided with an opening 30 which communicates with a countersink 31 extending inwardly from the back of the butt plate and with the axis of the opening 30 being substantially in alignment with the axis of the opening 20 when the butt plates 13 and 14 are in generally parallel relationship with each other. A female catch memeber 32 is loosely carried by the butt plate 14 and such female catch member is made of a resilient thermoplastic material such as nylon, polyethylene, polyurethane and the like.

The female member 32 includes a generally frusto-conical base 33 connected by a reduced throat 34 to an enlarged generally cylindrical head 35 and the outer end of the head 35 is provided with a chamfer 36. The diameter of the head 35 is slightly greater than the diameter of the opening 30 and the throat 34 is of a diameter less than such opening so that the head 35 can be force-fitted through the opening 30. The frusto-conical base 33 is slightly smaller than the countersink 31 to permit limited relative movement between the female catch member 32 and the butt plate 14, particularly in a lateral direction.

The female catch member 32 is provided with an axial bore 37 of a diameter less than the diameter of the head 25 of the male catch member, and a counterbore 38 of a diameter slightly less than the diameter of the head 25 so that when the catch members 22 and 32 are in assembled relationship, the interacting elastic forces are not totally relaxed. The counterbore 38 is connected to the bore 37 by a shoulder 39. The outer end of the head 35 of the female catch member is provided with an inwardly tapered frusto-conical surface 40 which terminates at the bore 37.

As illustrated best in FIG. 4, the female catch member 32 is of a length so that the head 35 engages the butt plate 13 when the butt plates 13 and 14 are in generally parallel relationship so that the female catch member 32 functions as a stop to insure generally parallel alignment of the butt plates.

In the operation of the device, the male and female catch members 22 and 32, respectively, normally are loosely mounted in the butt plates 13 and 14 at a manufacturing plant and are shipped to the customer in this condition. At this time each of the catch members is movable to a limited degree, both laterally and in and out relative to the associated butt plates. However, such catch members cannot be easily removed. When the hinges 12 are attached to the fixed structure 10 and the door 11 by the screws 15, such fixed structure and door function as backing plates which resist in-and-out movement of the catch members and thereby permit only slight in-and-out movement while still permitting lateral movement. As the door 11 is closed, the chamfer 27 of the male catch member engages the frusto-conical surface 40 of the female catch member and moves the catch members laterally relative to each other so that the head 25 of the male member is aligned with the axial bore 37 of the female member.

When the male and female catch members are in alignment, further closing motion of the door causes the head 25 of the male catch member 22 to penetrate the axial bore 37 of the female catch member. During this movement the head 25 of the male catch member is compressed, while the axial bore 37 if the female member is expanded as the head 25 passes through the axial bore into the counterbore 38. Since the diameter of the head 25 is slightly greater than the diameter of the counterbore 38, the assembled catch members are frictionally held together by an interference fit to prevent any rattle of the door. Also the shoulder 39 between the bore 37 and the counterbore 38 resists easy withdrawal of the head 25. As the head 25 enters the counterbore 38, the outer end of the head 35 of the female catch member engages the butt plate 13 when the butt plates 13 and 14 are substantially parallel with each other.

I claim:

1. The combination of a hinge and catch comprising a hinge having first and second pivotally connected wings, said wings normally being in spaced substantially parallel relationship with each other, a male catch member axially and laterally movably mounted on said first hinge wing, said male member having an enlarged portion extending outwardly from said first hinge wing toward said second hinge wing, a female catch member axially and laterally movably mounted on said second hinge wing, a portion of said female catch member extending outwardly toward said first hinge wing, said female catch member having a recess of a size to snugly receive said enlarged portion of said male catch member when said first and second wings are generally parallel, and means for aligning said portion of said male catch member and the recess of said female catch member.

2. The combination of a hinge and catch comprising a hinge having first and second pivotally connected wings, each of said wings having front and back sides, said front sides normally being in spaced substantially parallel relationship with each other when said hinge is closed, each of said wings having an opening with a countersink extending inwardly from said back side and communicating therewith, the opening of said first wing being generally aligned with the opening of said second wing, a male catch member loosely mounted in said opening and countersink of said first wing and a female catch member loosely mounted in said opening and countersink of said second wing, said male member having a frusto-conical base loosely received within said countersink of said first hinge wing and having an enlarged head extending through said first wing to the front side thereof, said female catch member having a frusto-conical base loosely received within said countersink of said second hinge wing and having a head extending through said second wing to the front side thereof, said female catch member having an axial recess of a size to receive the enlarged head of said male member with an interference fit, and means on said male and female catch members for aligning the head of said male member with the recess of said female member, whereby when said male catch member is received within said female catch member, relative movement of said hinge wings is resisted.

3. The structure of claim 2 in which said head of said female catch member abuts said first hinge wing when said hinge wings are in generally parallel relationship.

4. The structure of claim 2 in which said male catch member and said female catch member are constructed of resilient material.

5. The structure of claim 4 in which a portion of said head of said male catch member is greater in cross-section than the size of the opening of said first wing and a portion of said head of said female catch member is greater in cross-section than the size of the opening of said second wing so that said male and female catch members are retained within said openings.

6. The combination of a hinge and catch comprising a hinge having first and second wings which are in generally parallel relationship when the hinge is closed, each of said wings having an opening communicating with a countersink, the countersink of each hinge wing being on the back side of said wing, a male catch member loosely mounted in the opening and countersink of said first wing and a cooperating female member loosely mounted in the opening and countersink of said second wing, said male member having a frusto-conical base connected by a reduced throat to an enlarged head, said base of said male member being loosely received within the countersink of said first hinge wing and said throat being loosely received within the opening of said first hinge wing, said base and said head of said male member being larger in diameter than the diameter of the opening in said first hinge wing, said female catch member having a frusto-conical base connected by a reduced throat to an enlarged head, said base being loosely received within the countersink of said second hinge wing and said throat being loosely received within the opening of said second hinge wing, said base and said head of said female catch member being larger in diameter than the diameter of the opening in said second hinge wing, said female catch member having an axial recess of a size to receive said enlarged head of said male member with an interference fit, and means on said male and female catch members for aligning said head of said male member with the recess of said female member, whereby said male and female catch members are retained by said hinge wings and said head of said male member is received within the recess of said female member when said hinge wings are in generally parallel realtionship.

* * * * *